United States Patent [19]

Barker et al.

[11] Patent Number: 4,771,827

[45] Date of Patent: Sep. 20, 1988

[54] AUTOMATIC DROP-OFF DEVICE FOR PERFORATING GUNS

[75] Inventors: James M. Barker, Katy; Timothy M. Miller, Sugarland, both of Tex.

[73] Assignee: Halliburton Company, Duncan, Okla.

[21] Appl. No.: 41,500

[22] Filed: Apr. 23, 1987

[51] Int. Cl.[4] ..... E21B 43/117

[52] U.S. Cl. ..... 166/55.1; 166/377; 175/4.56

[58] Field of Search ..... 166/297, 55.1, 377; 175/4.56

[56] References Cited

U.S. PATENT DOCUMENTS

| | | | |
|---|---|---|---|
| 4,040,482 | 8/1977 | Vann | 166/297 X |
| 4,523,643 | 6/1985 | McGlothen | 166/297 |
| 4,526,233 | 7/1985 | Stout | 166/377 X |
| 4,554,981 | 11/1985 | Davies | 166/297 X |
| 4,601,492 | 7/1986 | George | 166/318 X |

*Primary Examiner*—Hoang C. Dang
*Attorney, Agent, or Firm*—William J. Beard

[57] ABSTRACT

A perforating gun assembly is set forth in the present disclosure. It incorporates an upper elongate body having a firing head. The body supports a lower carrier which encloses one or more shaped charges which are positioned for forming perforations into a formation of interest. The sole means by which the carrier is attached to the body utilizes an upwardly extending set of parallel collet fingers having enlargements on the end. The collet fingers are locked in position against a conforming shoulder. Locking is achieved by a pressure movable piston. The piston is forced by detonation gases from the shaped charges away from the locked position, and the collet fingers are then permitted to flex, pulling free of the conforming shoulder to enable the carrier to drop from the elongate body.

15 Claims, 2 Drawing Sheets

AUTOMATIC DROP-OFF DEVICE FOR PERFORATING GUNS

BACKGROUND OF THE DISCLOSURE

It is customary to perforate a completed oil well to obtain production from the adjacent formations. The ideal perforation is relatively large in diameter and penetrates as deep as possible. A large and deep hole best provides a flow path from the producing formation. This flow path must typically extend from the formation through the cement around the casing and also through the casing. A relatively large and deep perforation is therefore desirable to reduce pressure drop along the flow path to assure proper production from the formation into the borehole for collection in the cased well. There are however, physical constraints on obtaining such large and deep perforations.

Ordinarily, a tubing string is placed in the well within the casing. The size of the tubing string limits the size of the through-tubing perforating gun assembly. A popular tubing string has a nominal size of 2⅜" which provides an ID of 1.995". When this tubing string is installed along with the necessary completion components (e.g., nipples, sliding sleeves, safety valves, etc.), the minimum ID clearance is normally decreased from the nominal measure just stated. It is not uncommon to have an ID of 1.875" or even as low as 1.781". Given these dimensions, the diameter of the perforating gun assembly is thus limited. Common through-tubing perforating gun assemblies are typically 1 9/16" OD with a hollow carrier, or 1 11/16" OD if using an expendable carrier. Many circumstances prevent the use of an expendable carrier, including operation in a well that is unduly hot, one with hostile downhole fluids, or where the casing is weak or unsupported. In the event that a 1 9/16" OD hollow carrier gun is required, it typically is installed with a 3.0 gram explosive charge. Such an explosive charge will provide (in accordance with the API RP-42 concrete test) an entrance hole of 0.24" diameter and penetration of 6.17". Regrettably, firing of the perforating gun provides swelling to about 1.68" OD. While this swelling can be acceptable in some circumstances, a larger and deeper perforation obtainable by using larger charges is much more desirable.

Consider the possibility of using shaped charges of the size normally conducted in a 2" OD gun. These shaped charges will carry much more powder, typically 7.5 grams. Utilizing the same test standard, they will provide an entrance hole diameter of 0.29" and about 10.30" penetration. The charges (normally run in 2" guns) can be conveyed in a thin-walled carrier that will pass through 1.781" restrictions. A typical carrier OD might be 1.750". While such a large perforating gun assembly can be conducted down the tubing string, it is difficult to retrieve because of swelling, and possibly even splitting, the thin-walled gun. The size (after swelling) is so large as to prevent retrieval through a typical 2⅜" completion string with the necessary installed apparatus.

It is desirable to drop the perforating gun assembly after operation so that retrieval of the support equipment can be accomplished without sticking the portion of the equipment which swells after operation.

It has been proposed to use frangible screws or other fasteners which hold the perforating gun assembly together. Ideally, one can size a frangible screw or pin which would timely shear. This requires balancing in that it must be sufficiently weak to shear in a wide range of circumstances and yet it must be strong enough to avoid shearing when the tool is run down the tubing string to the desired depth in the well. An example of such a structure is shown in U.S. Pat. No. 4,496,009 which utilizes an unfocused charge to assure that the shear screws or pins are broken. This has the drawback of requiring the use of a second kind of shaped charge in addition to those used for perforating. Furthermore, the unfocused shaped charges must be located as far as possible remote from the casing to prevent unintended casing damage on detonation. Such clearance is typically not available in limited clearance situations. It is therefore better to avoid frangible pins or screws and thereby avoid use of the unfocused charges.

The present apparatus enables disconnection of the perforating gun assembly to drop a portion thereof to enable retrieval of the remaining portion of the equipment. This apparatus utilizes a plug positioned selectively in a set of locked collet fingers. The plug operates as a piston. When the perforating guns are fired, the piston is then driven upwardly, the shift thereof releasing the collet fingers so that the entire assembly breaks into two parts. The device is further constructed so that outgassing of the shaped charges does not pose a problem during running into the well even in the presence of elevated temperatures.

This apparatus is summarized as a perforating gun assembly adapted to be run in a small ID, the assembly including a firing head at the upper end supporting a detent housing. A pressure responsive piston is deployed therein and has an upstanding stem, the stem collaborating with a set of spring operated plungers which lock the piston in an elevated position after firing. When the assembly is run into the hole, the piston is moved to the down position where it locks a set of collet fingers. The collet fingers join with a collet body which in turn supports the remainder of the perforating gun assembly therebelow. It includes a carrier with one or more shaped charges therein. Upon detonation, the piston is forced upwardly and locked in the elevated position after movement. When it moves, it releases a set of collet fingers and thereby enables the collet body to pull free. It drops away by gun blast and gravity and carries the carrier with it. It should be noted at this stage that the carrier is expanded or possibly split as a result of swelling at the locations where the shaped charges explode in the carrier.

DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 shows the perforating gun for running into a tubing string, which perforating gun is armed with shaped charges; and FIG. 2 shows the perforating gun of FIG. 1 after shifting to release the lower portions of the perforating gun assembly.

DETAILED DESCRIPTION OF THE PREFERRED EMBODIMENT

Figure 1:
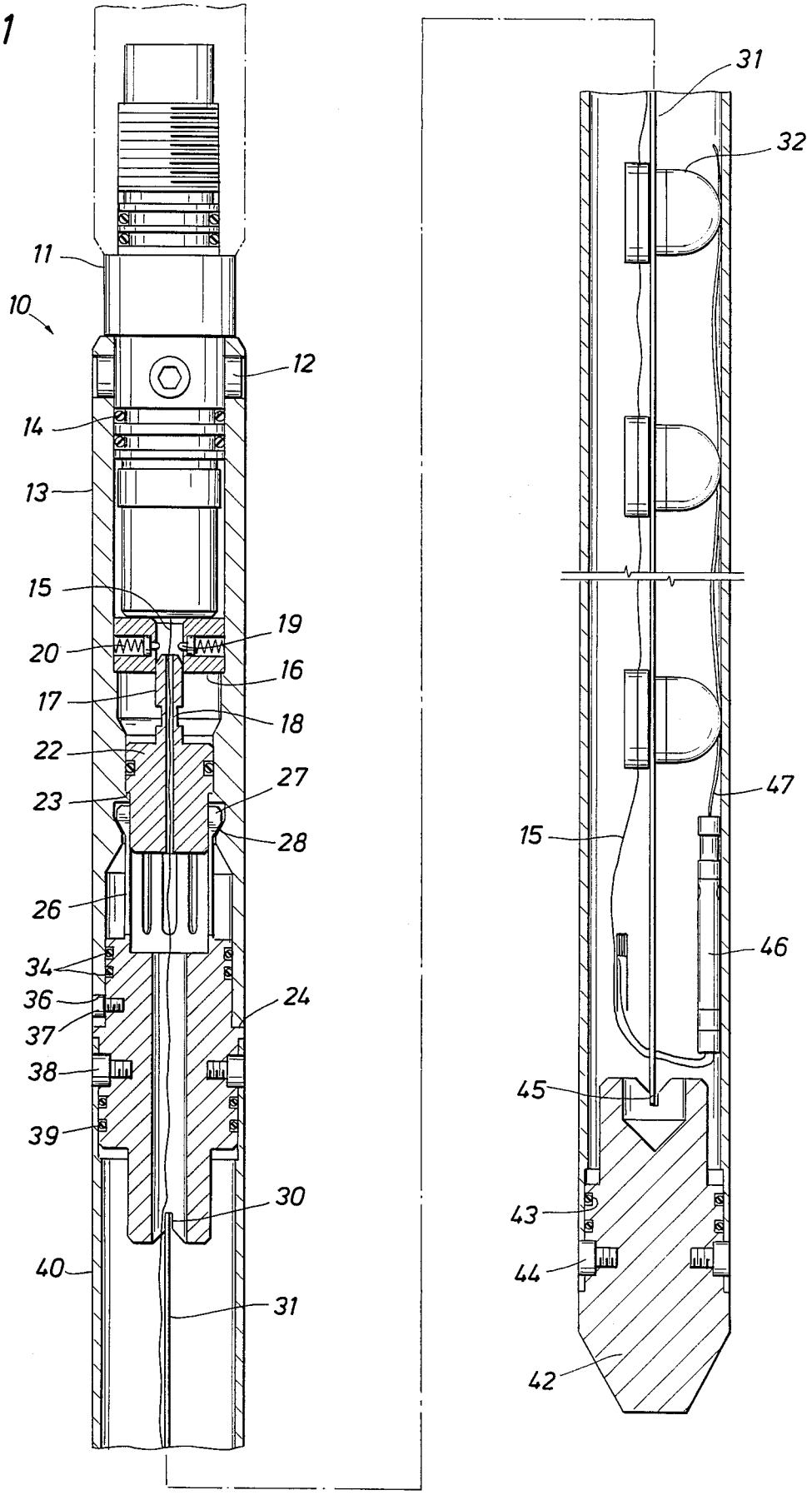

Attention is first directed to FIG. 1 of the drawings where the apparatus 10 will be described proceeding from the top of the sectional view. The structure includes a firing head 11 which is constructed to be joined with a rope socket and other running apparatus to enable the wireline operated device to be lowered in a tubing string. It is supported on a wireline which includes a signal conductor to provide the necessary signal for firing the shaped charges. The firing head is held in position by suitable allen head bolts 12 which joint to a detent housing 13. It is a hollow structure extending below the firing head which seals to the firing head at a set of seal rings 14. The firing head is operatively connected to a firing wire 15 deployed along the tool.

The detent housing 13 is axially hollow. It has an internal shoulder which serves as a lock for a stop ring 16. It locks against the firing head assembly which is on the interior of the detent housing 13. The stop ring 16 is constructed with an axial passage to serve as a guide for a lock pin 17. The lock pin extends upwardly into the passage and is able to telescope into the passage. Further, the pin 17 is notched with a circular undercut at 18 to provide a locking groove. The locking groove is able to receive a plunger 19 which is forced into the groove by a spring 20. The spring 20 is located in the stop ring behind the plunger to force the plunger against the lock pin 17.

The lock pin 17 is attached at the upper end of a movable piston 22. The piston 22 has an enlarged shoulder 23 thereabout to limit travel downwardly. The piston 22 is able to move upwardly. When it moves upwardly, it forces the pin 17 upwardly into a location where locking occurs. The piston 22 is also drilled axially with a passage to enable the firing wire 15 to extend through the piston. Sufficient clearance is provided to enable movement without binding or pulling on the firing wire.

The detent housing 13 extends downwardly to terminate at a lower lip 24. The lower lip 24 abuts against a cooperative shoulder on a collet body 25. The body 25 is constructed with a set of collet fingers 26 extending upwardly therefrom. The fingers 26 are sized to fit around the edge of the piston 22. In other words, the piston 22 telescopes into the collet fingers. The collet fingers are made with suitable lengthwise finger splits. The collet fingers are also constructed with an enlargement 27 around the exterior of the piston. The enlargement is locked against a restraining detent 28. The detent 28 is an internal circular shoulder of sloping construction which conforms to the enlargement. In the arrangement of FIG. 1, the piston forces the enlargement 27 radially outwardly against the restraining detent 28 to assure locking. In this arrangement and so long as the piston is in the down position, it is impossible to pull the collet body downwardly because it is locked in the described manner.

The collet body is axially hollow, terminating in a slot 30 cut across the collet body. The slot 30 supports a charge carrier 31, a mounting strip of a sacrificial nature, and supports one or more shaped charges 32. The shaped charges are mounted on the strip 31 at spaced locations, typically mounted thereon by positioning the shaped charges in drilled holes in the strip. The upper end of the strip is positioned in the slot 30 for alignment purposes. The collet body is constructed at the upper end with a set of seal rings 34. The seal rings 34 provide pressure sealing to the detent housing 13.

Figure 2:
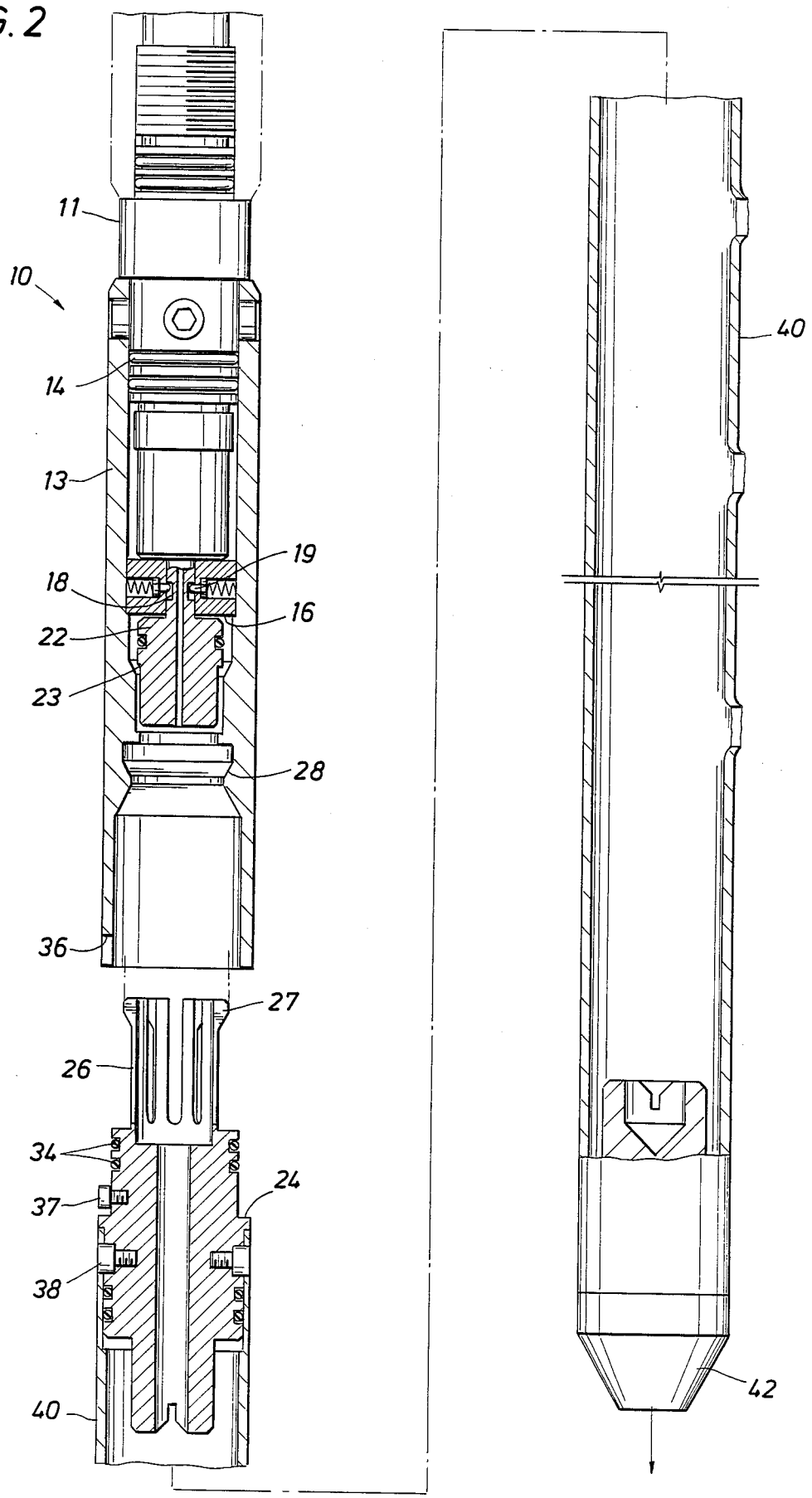

The collet body 25 is rotationally aligned to the detent housing at the lower shoulder 24. As shown in FIG. 2 of the drawings, there is a notch 36 formed in the detent housing to receive an alignment bolt 37. This assures proper angular rotation and positions the two components as they are joined together. Moreover, the collet body 25 is fastened to the carrier housing by bolts 38 which are isolated by suitable seal rings 39 therebelow. The rings 39 seal against the interior of an elongate, hollow, cylindrical carrier 40. This carrier encases the several shaped charges. The carrier 40 terminates at a bull plug 42 which closes the bottom end of the carrier 40 and is sealed thereagainst by suitable seal rings 43. The plug is held in position by bolts 44. It also supports the lower end of the charge holder 31 which is received in a axial hole and cooperative slot identified at 45. This arrangement assures that the several shaped charges are held at a desired angular orientation.

The firing wire 15 extends the length of the apparatus to connect to a detonator 46. That in turn connects with a detonating cord 47 which extends along the carrier housing. As will be understood, the several shaped charges are all connected for firing so that they form jet blasts in the intended fashion which perforate through the carrier 40 and out through the surrounding carrier and into the producing formation.

Operation of the Present Apparatus

Contrast FIG. 1 with FIG. 2 which shows the tool after firing. This is achieved by running the tool down a tubing string on the appropriately connected wireline until the tool is at a depth in the well opposite formations of interest. The tool is positioned at the required position to perforate through and into the formations of interest. At the proper time, a suitable electrical charge is provided, thereby assuring firing of the several shaped charges 32. When the tool is being run into the downhole location, there is a possibility that the explosives in the shaped charges will emit gases which will build up pressure; that is, the carrier 40 may build up internal pressure as a result of explosive outgassing. This risk is increased if the shaped charges are run into a hot well. In any case, the pressure in the carrier may build up. This pressure however, does not move the piston. There is a pressure relief flow path (48) through the piston which equalizes pressure on both sides of the piston. Thus, a slow or gradual build-up of pressure does not cause the piston to move. In the event the device operates in the intended fashion by detonation of the shaped charges, there is an instantaneous pressure build-up in the carrier 40. This rapid pressure build-up acts against the piston, forcing it upwardly. It slams upwardly against the lock ring. The groove 18 in the lock pin 17 receives the spring operated plungers which lock the piston 22 in the up position. The piston is held in the up position from this point in time, and is no longer available to lock against the collet fingers. The collet fingers are able to flex inwardly. This then releases the collet finger enlargements from the surrounding conforming shoulder. They deflect inwardly and slide over the streamlined shoulder 28, being pulled downwardly by gun blast and the weight of the structure therebelow. When the plug is in the up position of FIG. 2, the sole connection which holds the lower portions of the tool to the upper portions of the tool 10 is through the collet fingers. They deflect radially inwardly and release. When they release, they then flex inwardly, dropping the lower portion of the tool. Separation is achieved at the collet fingers. This drops the lower portion of the tool downhole and below the perforations. Typically, there is always room below the perforations to receive the lower portion of this spent apparatus.

It will be noticed in FIG. 2 that the carrier is perforated by operation of the shaped charges. This dimpling effect forms protrusions which extend outwardly, expanding the diameter of the apparatus and thereby preventing retrieval in tight clearance tubing strings. (Sometimes the carriers even split). The apparatus which remains connected to the wireline does not expand. It can therefore be retrieved upwardly through the tubing string just as it was inserted through the tubing string. This retrieval is easily accomplished in the ordinary fashion. The portion of equipment which is retrieved is thus shown in the top portions of FIG. 2. This portion of equipment is then used to reassemble the firing gun assembly 10 for subsequent use. The portion which is dropped away, including the fired shaped charges, is disposable apparatus and is replaced by a new set of equipment for subsequent downhole runs.

While the foregoing is directed to the preferred embodiment, the scope is determined by the claims which follow.

What is claimed is:

1. A perforating gun assembly adapted to be run into a tightly dimensioned well borehole for perforating into producing formations at a specified depth, the perforating gun assembly comprising:

(a) an elongate body adapted to be lowered into a tightly dimensioned passageway along a well;

(b) a carrier for supporting one or more shaped charges thereon, said carrier being supported below said elongate body;

(c) connective means joining said body and carrier coaxially together for running into a well borehole for subsequent separation wherein said connective means connects to said body and carrier and includes:

(1) a circular set of extending collet fingers having engaging surfaces thereon and adapted to flex, said fingers flexing radially inwardly and outwardly;

(2) a surrounding sleeve about said collet fingers having a collet finger engaging surface cooperative with said finger engaging surfaces;

(3) piston means abutting said collet fingers to lock said collet fingers against flexing wherein said collet fingers are prevented from flexing radially;

(4) said connective means further including a closed chamber for applying fluid pressure against said piston means;

(5) said collet fingers and said sleeve serially joining together said body and said carrier for supporting said carrier below said body to form the perforating gun assembly;

(6) and further wherein said chamber selectively applies fluid pressure against said piston means to move said piston means from the abutting position against said collet fingers to permit said collet fingers to flex radially to enable the enlargements on said collet fingers to disengage the finger engaging surface of said sleeve;

(7) wherein such piston movement enables collet finger movement which enables said body and carrier to separate;

(8) an axial passage through said piston means from said carrier to controllably permit explosive gasses occurring on detonation of shaped charges therein to escape through said passage; and (9) wherein said piston means has sufficient cross-sectional area to respond to detonation of shaped charges to move from the initial position against said collet fingers.

2. The apparatus of claim 1 wherein said sleeve is joined to said body, and said collet fingers are formed on a circular member attached to said carrier.

3. The apparatus of claim 2 wherein said carrier comprises an elongate hollow closed housing having shaped charges therein and wherein said shaped charges, on detonation, increase pressure within said elongate hollow closed housing to cause pressure induced movement of said piston means.

4. The apparatus of claim 1 including conductor means extending through said passage means for delivery of a firing signal from upper portions of the perforating gun assembly to the shaped charges in said carrier.

5. The apparatus of claim 1 wherein said sleeve incorporates a peripheral notch, said notch receiving a register means fixed relative to said collet fingers to align said fingers relative to said notch, and wherein said collet fingers support said carrier.

6. The apparatus of claim 1 wherein said piston moves to a position which permits said collet fingers to flex and thereby move past said collet finger engaging surface circularly arranged relative to said collet fingers.

7. A perforating gun assembly adapted to be run into a tightly dimensioned well borehole for perforating into producing formations at a specified depth, the perforating gun assembly comprising:

(a) an elongate body adapted to be lowered into a tightly dimensioned passageway along a well;

(b) a carrier for supporting one or more shaped charges thereon, said carrier being supported below said elongate body;

(c) connective means joining said body and carrier coaxially together for running into a well borehole for subsequent separation wherein said connective means connects to said body and carrier and includes:

(1) a circular set of extending collet fingers having engaging surfaces thereon and adapted to flex, said fingers flexing radially inwardly and outwardly;

(2) a surrounding sleeve about said collet fingers having a collet finger engaging surface cooperative with said finger engaging surfaces;

(3) piston means abutting said collet fingers to lock said collet fingers against flexing wherein said collet fingers are prevented from flexing radially;

(4) said connective means further including a closed chamber for applying fluid pressure against said piston means;

(5) said collet fingers and said sleeve serially joining together said body and said carrier for supporting said carrier below said body to form the perforating gun assembly;

(6) and further wherein said chamber selectively applies fluid pressure against said piston means to move said piston means from the abutting position against said collet fingers to permit said collet fingers to flex radially to enable the enlargements on said collet fingers to disengage the finger engaging surface of said sleeve;

(7) wherein such piston movement enables collet finger movement which enables said body and carrier to separate;

(8) wherein said carrier encloses said shaped charges in a closed chamber confining pressure in said closed chamber so that pressure increases on detonation of said shaped charges; and (9) wherein said piston means has a bypass passage of constricted diameter to enable pressure below said piston means to flow therepast and said passage is sized so that gradual increases in pressure do not move said piston means while sudden increases of pressure move said piston means.

8. The apparatus of claim 7 wherein said piston means includes a conforming lock and detent cooperative with said piston means to secure said piston means after movement thereof.

9. The apparatus of claim 8 further including a central upstanding lock pin on the top of said piston means and extending thereabove, said lock pin having a detent receiving cavity.

10. The apparatus of claim 7 wherein said sleeve is joined to said body, and said collet fingers are formed on a circular member attached to said carrier.

11. The appartus of claim 7 wherein said carrier comprises an elongate hollow closed housing having shaped charges therein and wherein said shaped charges, on detonation, increase pressure within said elongate hollow closed housing, and said passage delivers pressure to said closed chamber for movement of said piston means.

12. The apparatus of claim 7 wherein said piston means incorporates a protruding latch means, and further including conforming and mating means for engaging said latch means so that said piston means is locked and held after movement of said piston means.

13. The apparatus of claim 7 including conductor means extending through said passage means for delivery of a firing signal from upper portions of the perforating gun assembly to the shaped charges in said carrier.

14. The apparatus of claim 7 wherein said sleeve incorporates a peripheral notch, said notch receiving a register means fixed relative to said collet fingers to align said fingers relative to said notch, and wherein said collet fingers support said carrier.

15. The apparatus of claim 7 wherein said piston moves to a position which permits said collet fingers to flex and thereby move past said collet finger engaging surface circularly arranged about said collet fingers.

* * * * *